US006550907B2

(12) United States Patent
Uchida

(10) Patent No.: US 6,550,907 B2
(45) **Date of Patent: *Apr. 22, 2003**

(54) RECORDING APPARATUS

(75) Inventor: Kota Uchida, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/890,514

(22) Filed: Jul. 9, 1997

(65) Prior Publication Data

US 2001/0040616 A1 Nov. 15, 2001

(30) Foreign Application Priority Data

Jul. 11, 1996 (JP) ..... 8-182039

(51) Int. Cl.[7] ..... B41J 2/01
(52) U.S. Cl. ..... 347/104
(58) Field of Search ..... 347/104; 271/114, 271/272, 273, 258.01, 265.01, 17, 270, 69, 314, 3.18, 3.2; 400/582, 636.1, 637.1, 708, 709

(56) References Cited

U.S. PATENT DOCUMENTS

| | | | | | |
|---|---|---|---|---|---|
| 4,598,300 | A | | 7/1986 | Ono | |
| 4,681,313 | A | * | 7/1987 | Yokovama | 271/273 |
| 5,026,041 | A | | 6/1991 | Kitazume et al. | 271/118 |
| 5,121,343 | A | * | 6/1992 | Faris | 358/1.12 |
| 5,170,183 | A | * | 12/1992 | Hirabayashi et al. | 347/104 |
| 5,423,620 | A | * | 6/1995 | Tokairin | 400/582 |
| 5,598,201 | A | * | 1/1997 | Stodder et al. | 347/104 |
| 5,602,571 | A | * | 2/1997 | Suda et al. | 347/104 |
| 5,808,647 | A | * | 9/1998 | Kurata et al. | 347/104 |
| 5,867,196 | A | * | 2/1999 | Kiyohara et al. | 347/104 |

FOREIGN PATENT DOCUMENTS

| | | |
|---|---|---|
| EP | 0478300 | 4/1992 |
| EP | 0529606 | 3/1993 |
| EP | 0556045 | 8/1993 |
| EP | 0573987 | 12/1993 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A recording apparatus includes a recording section, a convey section, and a discharge section. The invention further includes an urging device for urging a pinch roller against a recording sheet, an urging force controller for controlling an urging force of the urging device, and a detector for detecting that a trail end of the recording sheet is conveyed to a predetermined position disposed upstream of a position where the trail end of the recording sheet leaves the pinch roller. The urging force controller reduces or releases the urging force of the urging device on the basis of a detection result from the detector, thereby eliminating the force of the pinch roller acting on the trail end of the recording sheet. The apparatus prevents the conveying accuracy of the recording sheet from being adversely affected.

11 Claims, 10 Drawing Sheets

RECORDING APPARATUS

BACKGROUND OF THE INVENTION

1. Field of the Invention

The present invention relates to a recording apparatus such as a printer, a copying machine, a word processor, a personal computer, a facsimile and the like. More particularly, it relates to a recording apparatus in which a recording sheet is pinched between and conveyed by a pinch roller and a convey roller and, after recording, the recording sheet is pinched between and discharged by a discharge roller and spur wheels.

2. Related Background Art

An example of conventional techniques with reference will be explained to FIG. 13, a pinch roller 5 is always urged against a recording sheet 3 or a convey roller 4. Further, a discharge roller 11 is selected to have a convey amount slightly greater than that of the convey roller 4 so that tension is applied to the recording sheet 3 to eliminate looseness of the recording sheet and permit the recording under a good condition. After the recording sheet 3 leaves the pinch roller 5, the recording sheet is discharged mainly by a conveying force of the discharge roller 11.

However, the above-mentioned conventional technique has the following disadvantages.

(1) When a trail end of the recording sheet 3 leaves the pinch roller 5, as shown in FIG. 4, the recording sheet is subjected to a force F directed toward a downstream direction and a downward direction, so that, since a convey distance of the recording sheet 3 is increased and conveying accuracy is worsened, recording accuracy at a rear end portion of the recording sheet 3 is worsened.

(2) After the trail end of the recording sheet 3 leaves the pinch roller 5, since the recording sheet is conveyed mainly by the discharge roller 11 and spur wheels 12 which are rotated faster than the convey roller 4, a convey distance of the recording sheet 3 per one line space is increased to worsen the conveying accuracy, thereby worsening the recording accuracy at the rear end portion of the recording sheet 3.

SUMMARY OF THE INVENTION

To eliminate the above-mentioned conventional drawbacks, the present invention provides a (first) recording apparatus comprising a recording portion for effecting the recording on a recording sheet, a convey means for conveying the recording sheet to the recording portion by pinching the recording sheet between a pinch roller and a convey roller, and a discharge means for discharging the recording sheet by pinching the recording sheet between a spur wheel and a discharge roller. It further comprises an urging means for urging the pinch roller against the recording sheet, an urging force controlling means for controlling an urging force of the urging means, and a detecting means for detecting the fact that a trail end of the recording sheet is conveyed up to a predetermined position disposed upstream of a position where the trail end of the recording sheet leaves the pinch roller, wherein the urging force controlling means reduces the urging force of the urging means on the basis of a detection result from the detecting means.

The present invention further provides a recording apparatus comprising a (second) recording portion for effecting the recording on a recording sheet, a convey means for conveying the recording sheet to the recording portion by pinching the recording sheet between a pinch roller and a convey roller, and a discharge means for discharging the recording sheet by pinching the recording sheet between a spur wheel and discharge roller. It further comprises an urging means for urging the pinch roller against the recording sheet, an urging force controlling means for controlling an urging force of the urging means, and a detecting means for detecting the fact that a trail end of the recording sheet is conveyed up to a predetermined position disposed upstream of a position where the trail end of the recording sheet leaves the pinch roller, wherein the urging force controlling means releases the urging force of the urging means on the basis of a detection result from the detecting means.

The present invention also provides a (third) recording apparatus comprising a recording portion for effecting the recording on a recording sheet, a convey means for conveying the recording sheet to the recording portion by pinching the recording sheet between a pinch roller and a convey roller, and a discharge means for discharging the recording sheet by pinching the recording sheet between a spur wheel and a discharge roller. It further comprises a rotation controlling means for controlling rotations of the convey roller and the discharge roller, and a detecting means for detecting the fact that a trail end of the recording sheet is conveyed up to a predetermined position disposed upstream of a position where the trail end of the recording sheet leaves the pinch roller, wherein the rotation controlling means reduces convey amounts of the convey roller and the discharge roller corresponding to one line space.

The present invention further provides a (fourth) recording apparatus comprising a recording portion for effecting the recording on a recording sheet, a convey means for conveying the recording sheet to the recording portion by pinching the recording sheet between a pinch roller and a convey roller, and a discharge means for discharging the recording sheet by pinching the recording sheet between a spur wheel and a discharge roller. It further comprises a rotation controlling means for controlling rotation of the discharge roller, and a detecting means for detecting the fact that a trail end of the recording sheet is conveyed up to a predetermined position disposed upstream of a position where the trail end of the recording sheet leaves the pinch roller, wherein the rotation controlling means reduces a convey amount of the discharge roller corresponding to one line space.

The first or second recording apparatus may further include a rotation controlling means for controlling rotation of the convey roller and the discharge roller so that the rotation controlling means reduces convey amounts of the convey roller and the discharge roller corresponding to one line space. Alternatively, the first or second recording apparatus may further include a rotation controlling means for controlling rotation of the discharge roller so that the rotation controlling means reduces convey amount of the discharge roller corresponding to one line space.

In the third recording apparatus, the rotation controlling means may set the convey amount of the discharge roller to become the same as a convey amount of the convey roller before detected by the detecting means. In the fourth recording apparatus, the rotation controlling means may set the convey amount of the discharge roller to become the same as a convey amount of the convey roller before detected by the detecting means.

When the first or second recording apparatus includes the rotation controlling means for controlling rotation of the convey roller and the discharge roller, the rotation controlling means may set the convey amount of the discharge roller to become the same as a convey amount of the convey roller before detected by the detecting means. When the first or second recording apparatus includes the rotation controlling means for controlling rotation of the discharge roller, the rotation controlling means may set the convey amount of the discharge roller to become the same as a convey amount of the convey roller before detected by the detecting means.

In any of the first to fourth recording apparatuses, the detection means may comprise a sensor disposed in the vicinity of the convey roller, and a rotation amount measuring means for measuring a rotation amount of the convey roller. In any of the first to fourth recording apparatuses, the recording portion may be of ink jet recording type in which the recording is effected by discharging ink in response to a signal.

In any of the first to fourth recording apparatuses, the recording portion may be of ink jet recording type in which the recording is effected by discharging ink by growth of a bubble formed by heating the ink to exceed the film-boiling temperature generated by energizing an electrical/thermal converter in response to a signal.

DETAILED DESCRIPTION OF THE PREFERRED EMBODIMENTS

Figure 1:
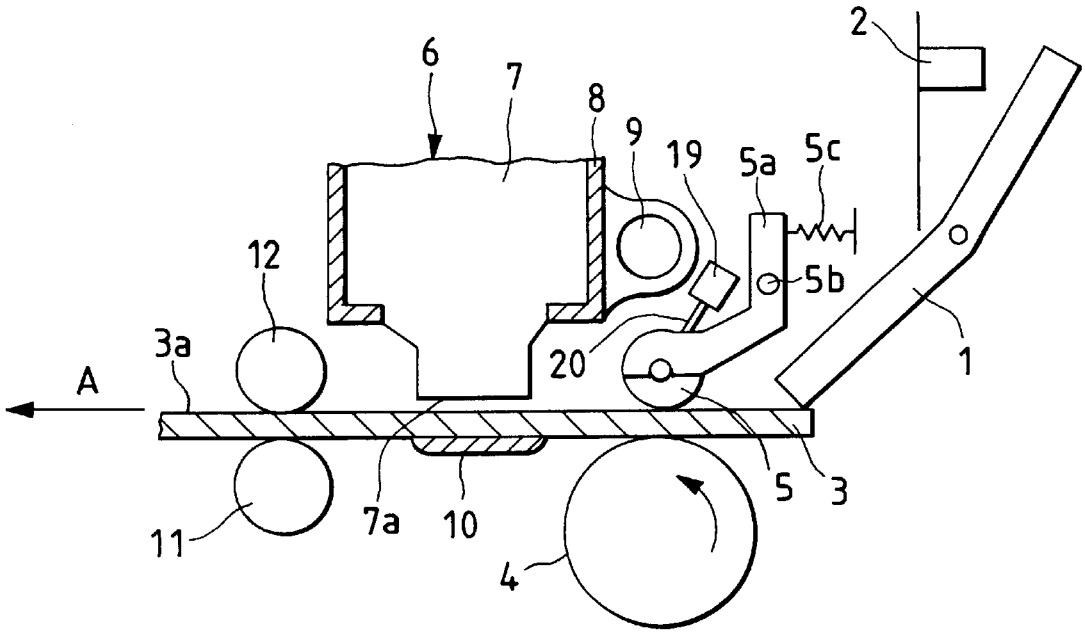
FIG. 1 is an explanatory view showing a portion of a recording apparatus according to a first embodiment of the present invention in a condition that a sensor lever abuts against a recording sheet.
Figure 2:
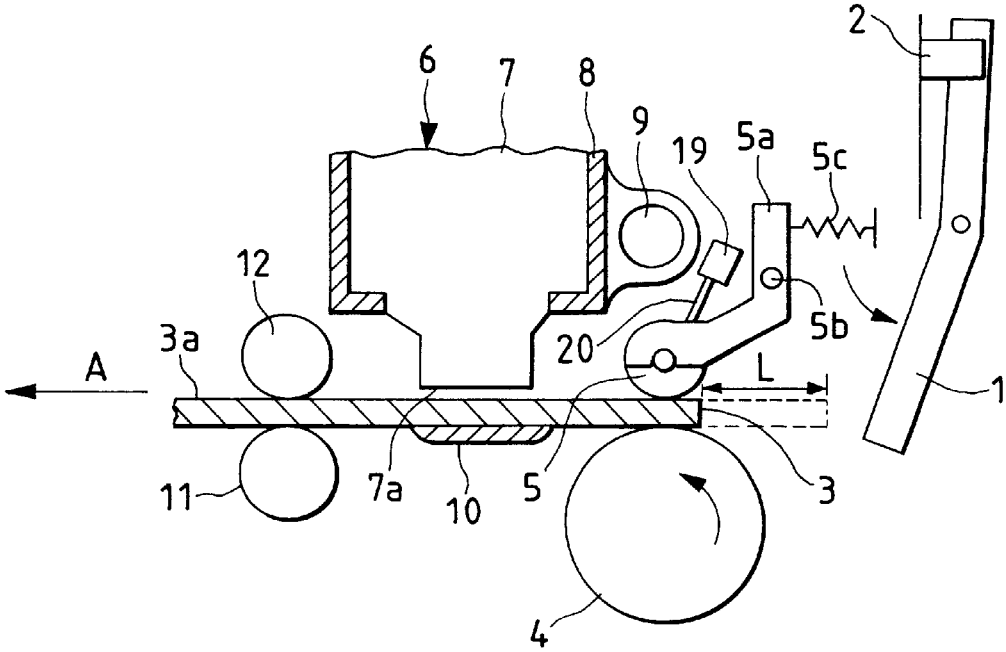
FIG. 2 is an explanatory view showing a condition that a trail end of the recording sheet has reached a pinch roller from a position shown in FIG. 1.
Figure 3:
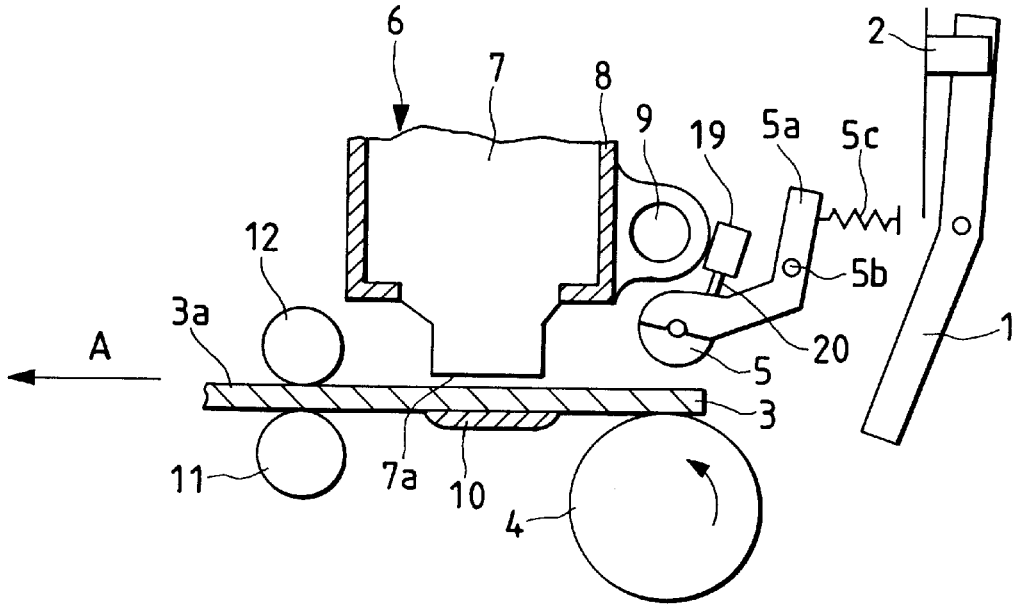
FIG. 3 is an explanatory view showing a condition that the pinch roller has been shifted upwardly from a position shown in FIG. 1.

FIGS. 1 to 3 are sectional views (showing a side of a convey path for a recording sheet) for explaining an ink jet recording apparatus according to a first embodiment of the present invention. In FIGS. 1 to 3, the arrow A indicates a conveying direction for the recording sheet. The recording sheet is conveyed from a condition shown in FIG. 1 to a condition shown in FIG. 3.

In FIG. 1, a pinch roller 5 is supported by a pinch roller holder 5*a* which is pivotally mounted on a pinch roller holder shaft 5*b* and is biased by a compression spring 5*c* so that the pinch roller is urged against a convey roller 4. The convey roller 4 cooperates with the pinch roller 5 to convey the recording sheet toward the conveying direction (shown by the arrow A). The convey roller 4 is driven by a convey motor (not shown) to convey the recording sheet 3 by a predetermined amount. A stepping motor is used as the convey motor. A sheet end detecting PE sensor lever 1 for the detecting presence/absence of the recording sheet 3 is disposed upstream of the convey roller 4 and the pinch roller 5 in the recording sheet conveying direction.

A carriage 8 provided in a recording portion 6 is supported by a guide shaft 9 for reciprocal movement in a direction perpendicular to the conveying direction A for the recording sheet 3. Further, a recording head (recording means) 7 is mounted on the carriage 8 to record on the recording sheet 3 conveyed onto a platen 10 by the convey roller 4 and the pinch roller 5. The recording means may be of ink jet recording type in which the recording is effected by discharging ink from the recording head. That is to say, the recording head 7 includes fine liquid discharge openings (orifices), liquid passages, energy acting portions provided in the respective liquid passages, and energy generating means for generating bubble forming energy to be applied to the liquid in the energy acting portions.

Regarding such energy generating means, there are recording systems using electrical/thermal converters such as piezo-electric elements, recording systems using energy generating means in which a liquid droplet is discharged by heating the liquid by means of electromagnetic wave such as laser, recording systems using energy generating means in which liquid is discharged by heating the liquid by means of an electrical/thermal converter such as a heat generating element including a heat generating resistance body, and the like.

In the recording head used in the ink jet recording system among the recording systems, since liquid discharge openings (orifices) for discharging recording liquid droplets can be arranged with high density, the recording can be effected with high resolving power. Further, the recording heads using electrical/thermal converters as the energy generating means can easily be made compact, can effectively utilize advantages of IC techniques and/or micro-working techniques in which progress and reliability have been remarkably increased in a recent semi-conductor field, can easily be mounted with high density and can be made cheaper.

The recording head 7 can be moved so that a distance between a front surface 7*a* of the recording head and a recording surface 3*a* of the recording sheet 3 can be maintained properly in correspondence to a thickness of the recording sheet 3. Spur wheel(s) 12 are urged against a discharge roller 11 by spring(s) (not shown) to serve as a pinch roller for the discharge roller. The spur wheel(s) 12 cooperate(s) with the discharge roller 11 to discharge the recording sheet 3 onto a discharge tray (not shown) without smudging the recording surface 3*a* of the recording sheet 3.

Figure 5:
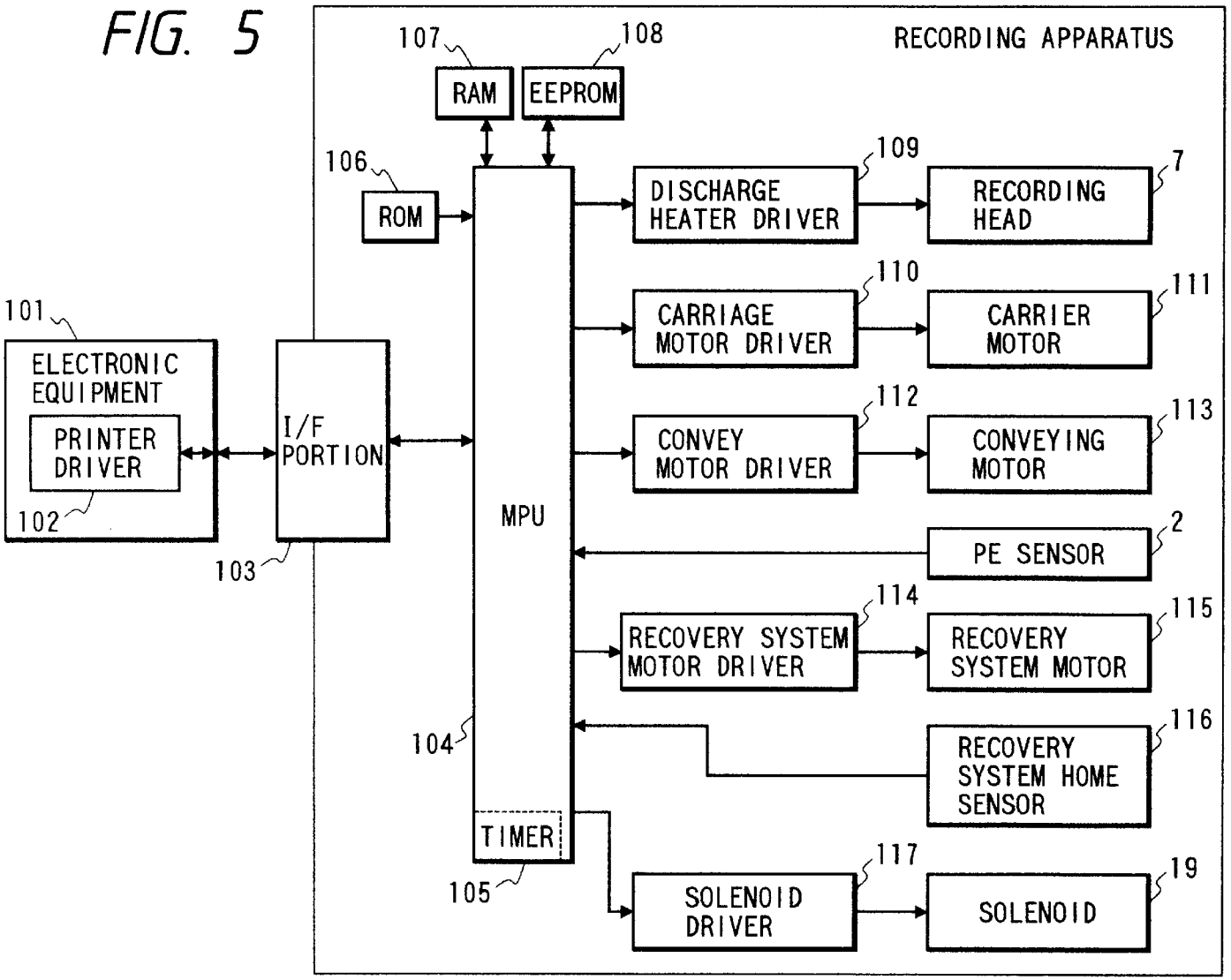
FIG. 5 is a block diagram showing a control portion of a recording apparatus according to first and second embodiments of the present invention.

FIG. 5 is a block diagram showing a control portion of the ink jet recording apparatus. An MPU 104 for controlling the entire apparatus has a control time governing timer 105. A ROM 106 serves to store control program of the MPU and the like, and a RAM 107 serves as a work area of the MPU 104 and serves to store information such as a speed of the carriage 8 and the like. An EEPROM 108 serves to protect the information even after a power source is turned OFF. A discharge heater driver 109 serves to drive a discharge heater for causing the recording head to discharge ink in response to recording information, and a carriage motor driver 110 serves to drive a carriage motor 111 for shifting the carriage 8 through a timing belt and pulleys (not shown). A convey motor driver 112 serves to control the driving of a convey motor 113 for driving the convey roller 4.

A PE sensor 2 for detecting the presence/absence of the recording sheet 3 and tip and trail ends of the recording sheet is disposed upstream of the convey roller 4. A recovery system motor driver 114 serves to control the driving of a discharge recovery treating apparatus such as an ink suction device (not shown) for restoring the recording head to a record permitting condition or for maintaining the recording head in the record permitting condition.

A sensor 116 serves to detect an operating position of a cam (not shown) of the discharge recovery treating apparatus. A solenoid driver 117 serves to control the driving of a solenoid 19 for controlling the urging of the pinch roller. An interface portion 103 connects the recording apparatus to a host computer so that the information can be communicated between the recording apparatus and the host computer through the interface portion. An electronic equipment 101 such as a computer, a word processor and the like connected to the recording apparatus through the interface portion 103, and a printer driver 102 serves to set various conditions regarding the recording apparatus and sends commands to the recording apparatus in accordance with the set conditions.

Next, a recording operation on the recording sheet 3 will be explained. One-line recording is performed on a predetermined position of the recording sheet 3 by the recording apparatus and then the recording sheet 3 is conveyed by an amount corresponding to one line space. Such one-line recording and conveyance of the recording sheet are alternately repeated. When the recording sheet 3 leaves the PE sensor lever 1, the trail end of the recording sheet is detected. As a result, the recording sheet 3 is conveyed by a predetermined distance L (FIG. 2) from a position where the PE sensor lever 1 was contacted with the recording sheet 3 to a position where the pinch roller 5 is contacted with the trail end of the recording sheet 3. In this case, since the stepping motor is used, the number of steps corresponding to the distance L is judged by a CPU. Consequently, the fact that the recording sheet has been conveyed up to a predetermined position situated upstream of a position where the recording sheet leaves the pinch roller. Preferably, the predetermined position can be appropriately selected within a range between a separation position where the recording sheet has just left the pinch roller and a position situated upstream of the separation position and spaced apart from the separation position by a distance corresponding to one line space.

That is to say, the MPU (control means) detects the fact that the trail end of the recording sheet 3 has passed through the PE sensor lever 1, by utilizing the PE sensor 2 and the PE sensor lever 1. After the trail end of the recording sheet 3 was detected by the PE sensor 2, when the stepping motor (convey motor 113) was rotated by the number of steps required for the convey roller to convey the recording sheet 3 by the predetermined distance L, the solenoid 19 is turned ON by the MPU.

Figure 4:
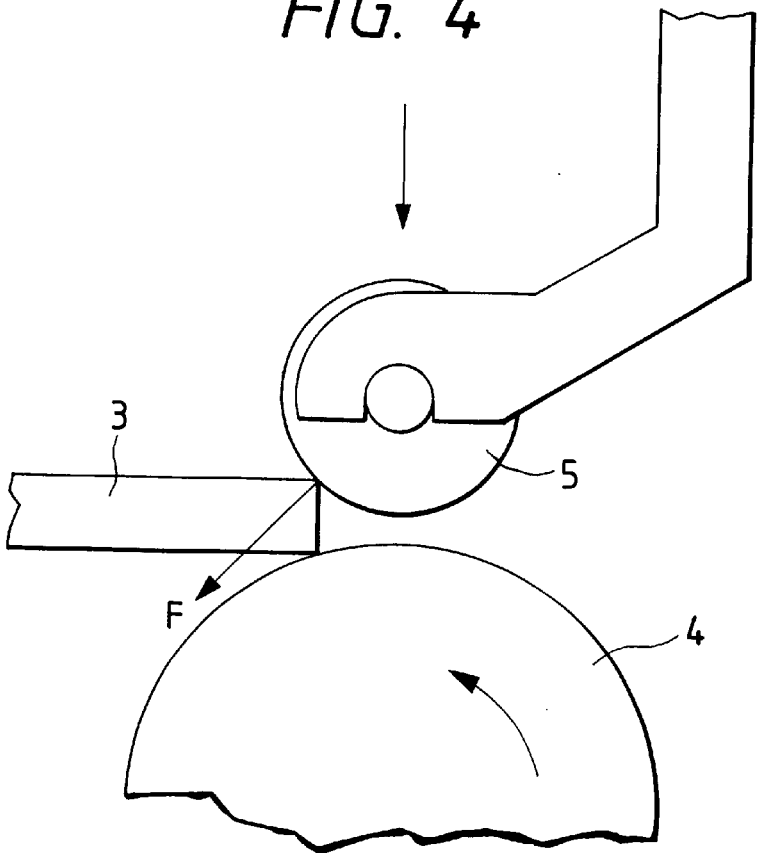
FIG. 4 is an explanatory view for explaining a force acting on the recording sheet from the pinch roller.

When the solenoid 19 is energized, a connection portion 20 between the pinch roller holder 5*a* and the solenoid is pulled toward the solenoid 19, so that the pinch roller holder is rotated upwardly around the pinch roller holder shaft 5*b*, thereby shifting the pinch roller 5 upwardly to separate the pinch roller from the recording sheet 3 (FIG. 3). As a result, the trail end of the recording sheet 3 is not subjected to a force (as shown in FIG. 4) toward a downstream direction. Thereafter, the recording sheet 3 is conveyed by the discharge roller 11 and the spur wheel(s) 12 to be discharged onto the discharge tray (not shown). In this way, a series of the recording operation is completed.

Thus, an increase in the convey distance of the recording sheet 3 due to the application of the force F can be prevented, and the convey accuracy of trail end of the recording sheet passing through the pinch roller can be prevented from being worsened.

In the above explanation, while an example that the urging (pressurizing) of the pinch roller 5 is released in order to release the downstream force F acting on the trail end of the recording sheet 3 was explained, when an urging force of the pinch roller 5 acting on the convey roller 4 is relatively small or when the recording sheet 3 is thin, the urging force of the pinch roller may be reduced or weakened, in place of complete release of the urging force of the pinch roller. In this case, the shift amount of the pinch roller 2 obtained by the solenoid 19 and the connection portion 20 may be selected to an amount that the pinch roller does not separate from the upper surface of the recording sheet.

(Second Embodiment)

Next, an embodiment in which a trail end of a recording sheet 3 is conveyed toward a downstream side by a pinch roller and then the recording sheet is conveyed by a discharge roller 11 and spur wheel(s) 12 will be explained.

Figure 8:
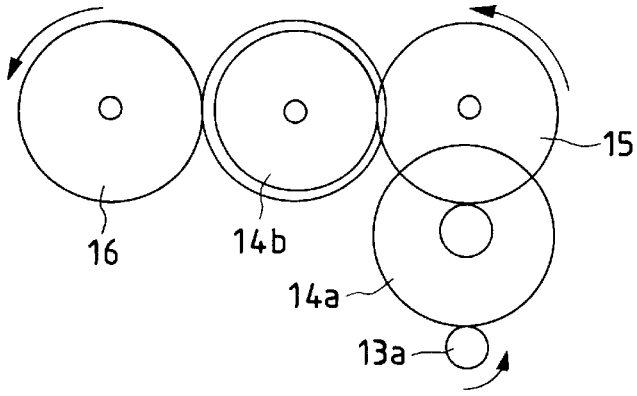
FIG. 8 is an explanatory view showing a concrete example of a drive system of the recording apparatus according to the second embodiment of the present invention.

In FIG. 8 (explanatory view for explaining an arrangement in which a convey roller and a discharge roller are driven by a common drive source), a driving force from a motor gear 13*a* is transmitted to a convey roller gear 15 through a two-stage gear 14*a* and then is transmitted to a discharge roller gear 16 through a two-stage gear 14*b*. A total speed reduction gear ratio from the convey motor to the convey roller gear 15 is selected to 1:15 and a total speed reduction gear ratio from the convey motor to the discharge roller gear 16 is selected to 2:29.

Figure 11A:
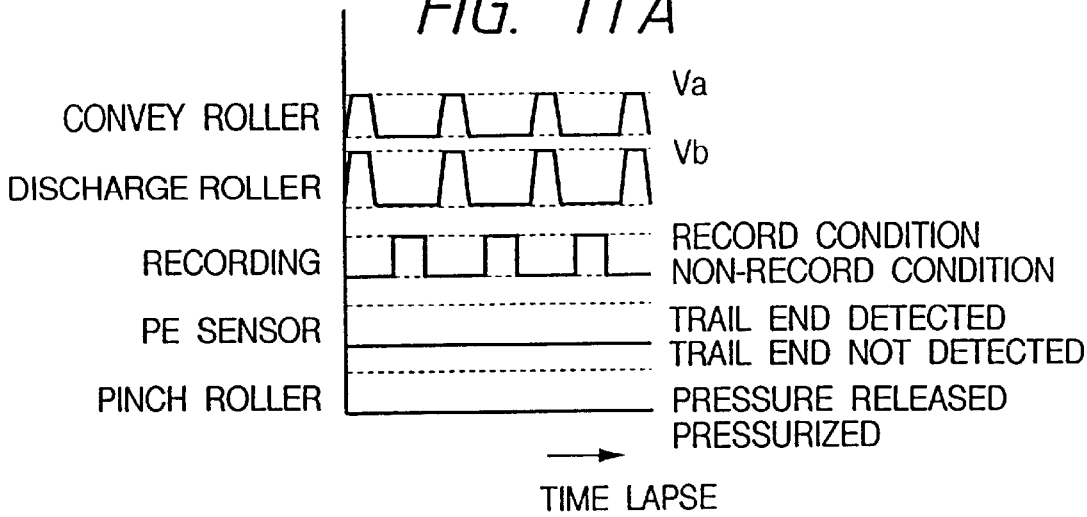
FIGS. 11A, 11B, 11C, 11D, 11E and 11F.

FIG. 11A shows a relation between time lapse (when the trail end of the recording sheet 3 is situated upstream of the pinch roller 5), and a convey amount condition of the recording sheet 3 by means of the convey roller 4, a convey amount condition of the recording sheet 3 by means of the discharge roller 11, a recording condition of the recording head, a detection condition of the PE sensor and a pressurizing condition of the pinch roller. In the illustrated embodiment, a convey amount Vb of the discharge roller is selected to become greater than a convey amount Va of the convey roller by 2 to 3%, so that the recording sheet 3 can be conveyed without looseness. Further, the recording operation is performed while the recording sheet 3 is not being conveyed. The PE sensor is in a condition that it does not detect the trail end of the recording sheet and the pinch roller is in the pressurizing condition.

In the recording operation regarding the recording sheet 3, the trail end of the recording sheet 3 is detected when the recording sheet 3 leaves the PE sensor lever 1, and the recording sheet 3 is conveyed by the predetermined distance L.

Figure 11B:
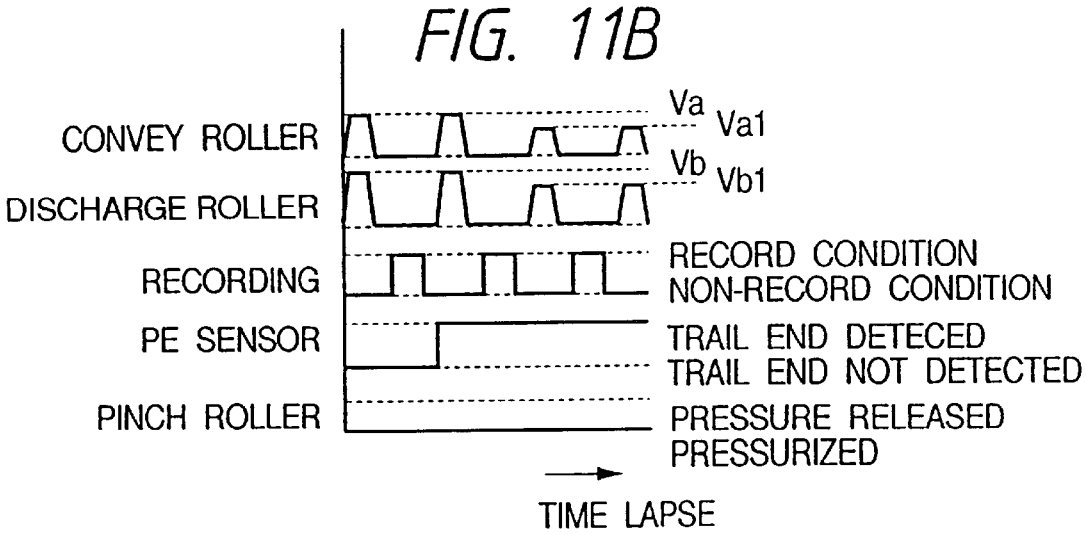

Now, the convey amount corresponding to one line space which was previously set is changed to a new amount. In the illustrated embodiment, before the trail end of the recording sheet 3 is contacted with the pinch roller 5, a convey amount of 48 steps per one line space is set in the convey motor 112, and, thereafter, the convey amount is changed to 47 steps per one line space. Such a driving condition is shown in FIG. 11B. In this condition, since the convey amount of the convey motor 113 corresponding to one line space is changed, the convey amount of the convey roller 4 is changed or reduced from Va to Va1 and the convey amount of the discharge roller 11 is changed or reduced from Vb to Vb1. Thus, even when the recording sheet is conveyed by the discharge roller 11 and the spur wheel(s) 12, since the recording sheet is conveyed by the predetermined distance without increasing the convey distance per one line space more than that before the trail end of the recording sheet is detected, the convey accuracy of the trail end of the recording sheet 3 can be prevented from being worsened.

Figure 11C:
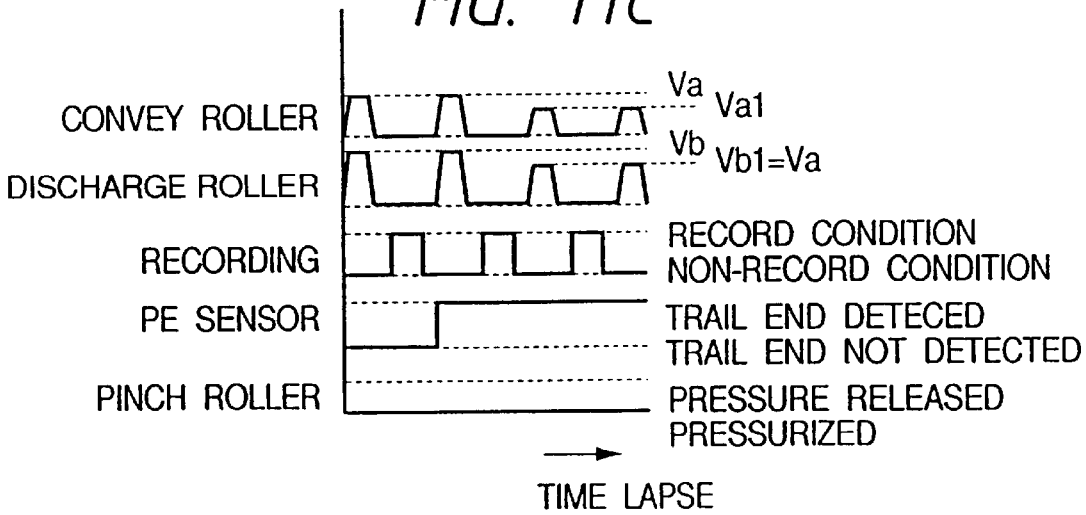

The changed convey amount Vb1 of the discharge roller 11 is not limited to a specific value but may be determined in accordance with material of the recording sheet 3 and/or discharging ability of the discharge roller 11. An example that the changed convey amount of the discharge roller is set to be equal to the convey amount of the convey roller 4 before the trail end of the recording sheet 3 is detected by the PE sensor 2 is shown in FIG. 11C. In this case, even when the recording sheet is conveyed by the discharge roller 11 and the spur wheels 12, the recording sheet 3 is conveyed without changing the convey distance per one line space between before and after the trail end of the recording sheet 3 is detected by the PE sensor 2. With this arrangement, the convey accuracy of the trail end of the recording sheet can be improved.

Figure 11D:
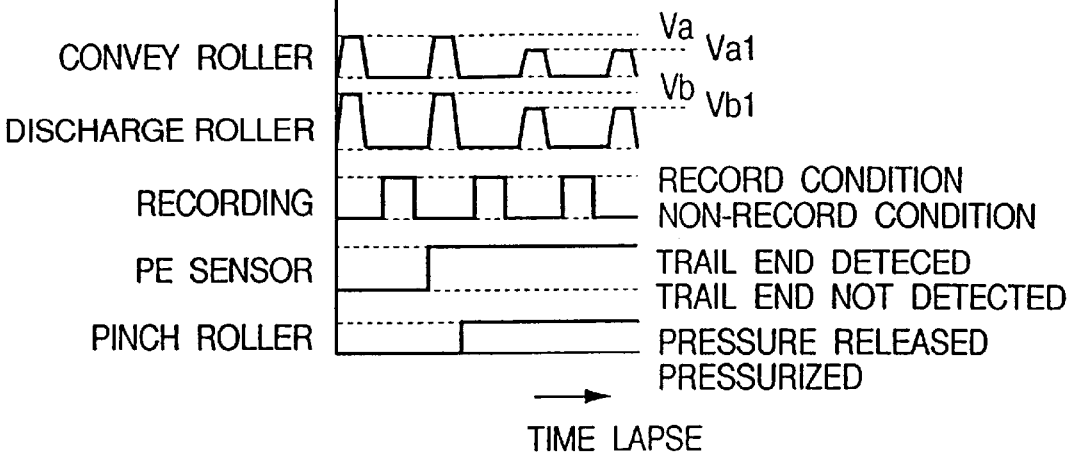
Figure 11E:
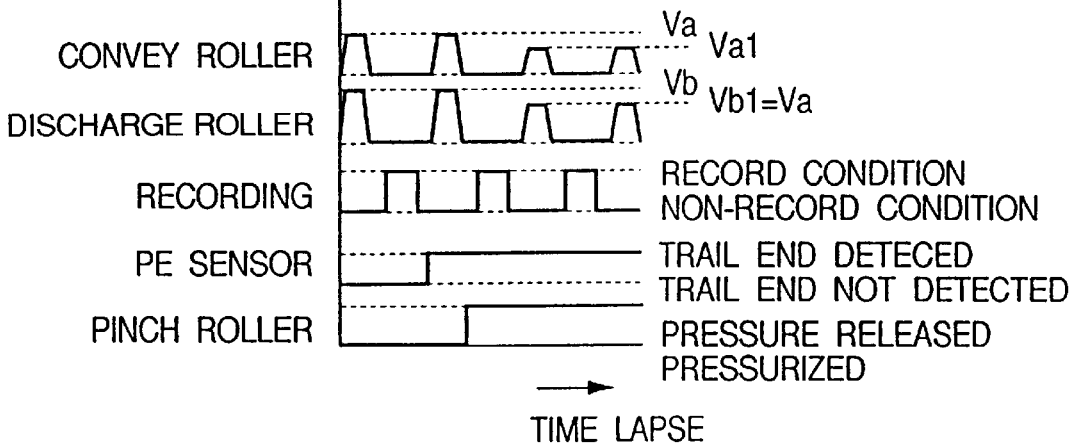

In the above explanation, while an example that the convey amount of the convey motor is changed after the trail end of the recording sheet 3 is passed through the pinch roller 5 was explained, such an example can be combined with the aforementioned embodiment. Such a combination is shown in FIGS. 11D and 11E. In this case, in addition to the advantage obtained by such an example, the increase in the convey distance of the recording sheet due to the downstream force F of the pinch roller 5 acting on the trail end of the recording sheet 3 can be prevented and further reduction of the convey accuracy can be prevented. Further, when this embodiment is combined with the first embodiment, although the predetermined position can be appropriately selected within the range between the separation position where the recording sheet has just left the pinch roller and the position situated upstream of the separation position and spaced apart from the separation position by the distance corresponding to one line space, the predetermined position may be situated upstream of such a range.

(Third Embodiment)

Figure 9:
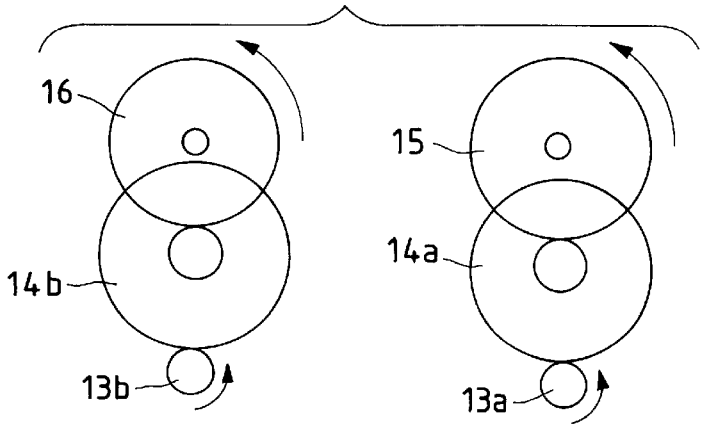
FIG. 9 is an explanatory view showing a concrete example of a drive system of the recording apparatus according to the third embodiment of the present invention.

Next, a further embodiment regarding constructions of convey and discharge rollers will be explained. In FIG. 9 showing an arrangement in which a convey roller and a discharge roller are driven by respective drive sources, a driving force of the convey roller 4 is transmitted from a motor gear 13*a* to a convey roller gear 15 through a two-stage gear 14*a* and a driving force of the discharge roller 11 is transmitted from a motor gear 13*b* to a discharge roller gear 16 through a two-stage gear 14*b*. A total speed reduction gear ratio from the convey motor to the convey roller gear 15 is selected to 1:15 and a total speed reduction gear ratio from the discharge motor to the discharge roller gear 16 is selected to 2:29.

Figure 6:
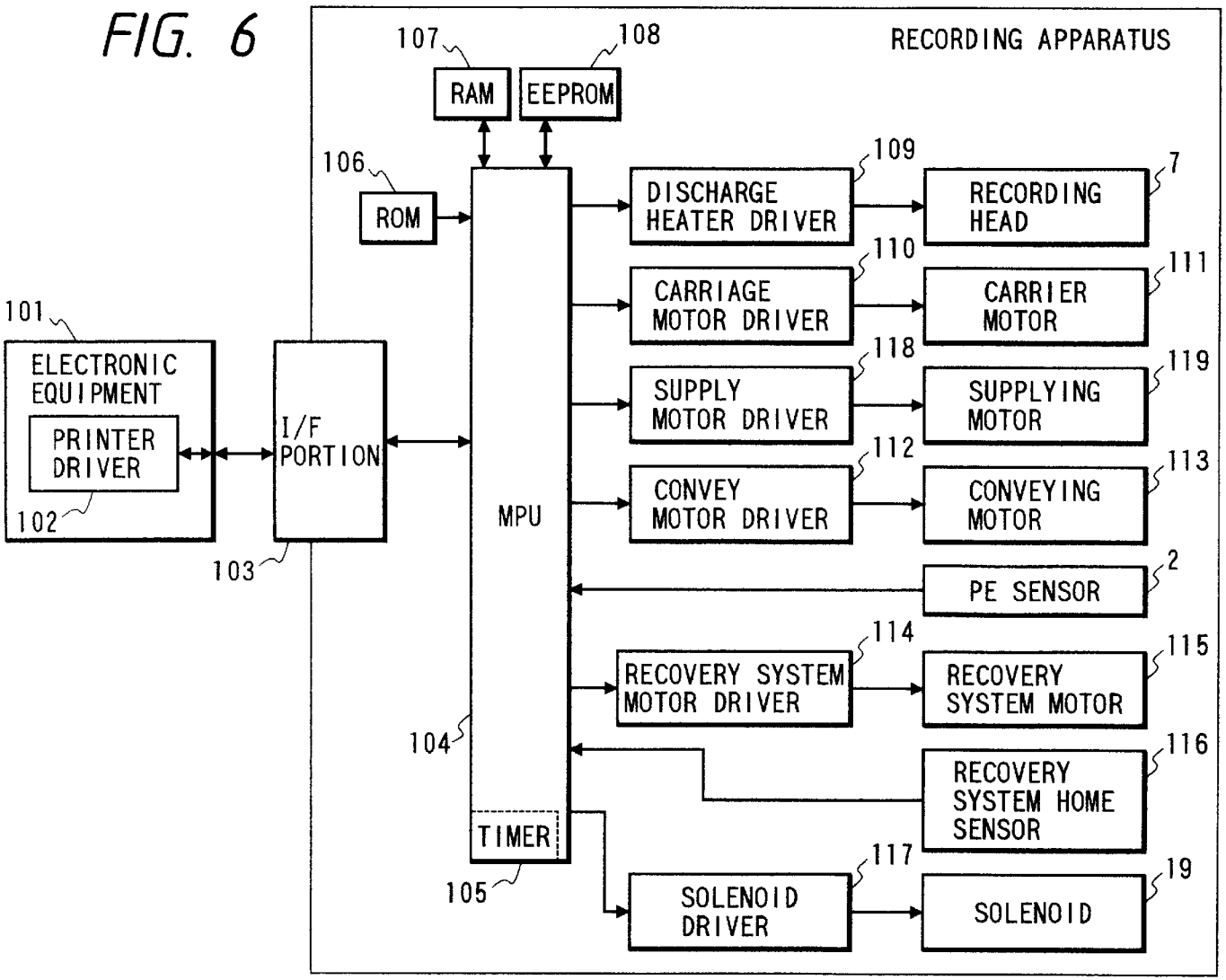
FIG. 6 is a block diagram showing a control portion of a recording apparatus according to a third embodiment of the present invention.

FIG. 6 is a block diagram showing a control portion of an ink jet recording apparatus according to this embodiment. In this control portion, a convey motor driver 118 for controlling the driving of the discharge motor 119 for driving the discharge roller 11 is added, in comparison with the control portion shown in FIG. 5.

In the recording operation regarding the recording sheet 3, the trail end of the recording sheet 3 is detected when the recording sheet 3 leaves the PE sensor lever 1, and the recording sheet 3 is conveyed by the predetermined distance L. Now, the convey amount corresponding to one line space which was previously set is changed from Vb to Vb1 smaller than Vb.

Figure 11F:
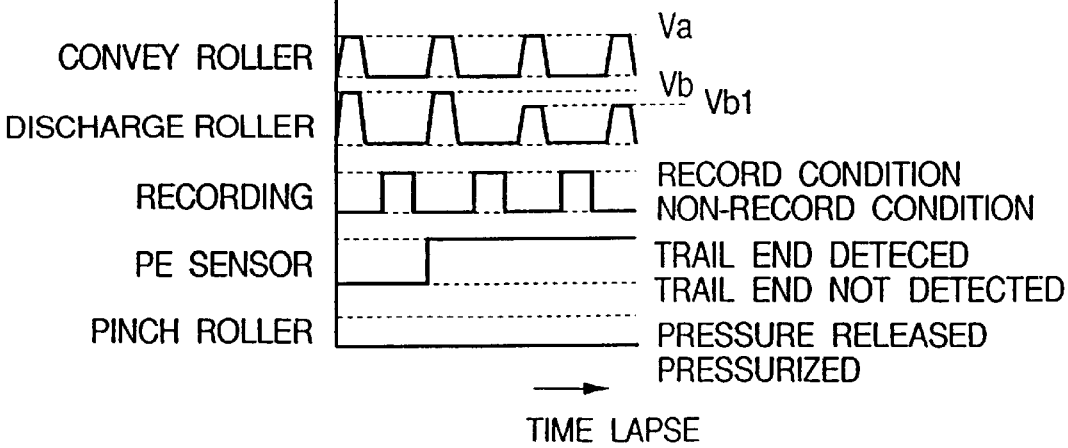

With this arrangement, even when the recording sheet is conveyed by the discharge roller 11 and the spur wheels 12, since the recording sheet 3 is conveyed without changing the convey amount per one line space between before and after the trail end of the recording sheet 3 is detected by the PE sensor 2, the convey accuracy of the trail end of the recording sheet can be prevented from being worsened. Incidentally, FIG. 11F shows a driving condition in this case.

Figure 12A:
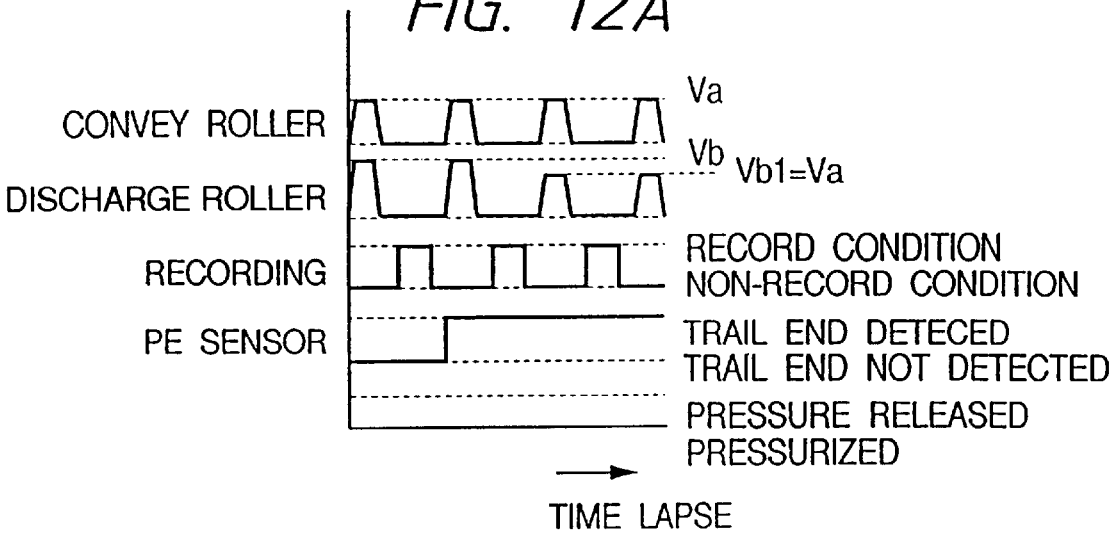
FIGS. 12A, 12B and 12C are explanatory views showing operating conditions of the recording apparatus according to the above-mentioned embodiments.

The changed convey amount Vb1 of the discharge roller 11 is not limited to a specific value but may be determined in accordance with material of the recording sheet 3 and/or discharging ability of the discharge roller 11. An example that the changed convey amount of the discharge roller is set to be equal to the convey amount of the convey roller 4 before the trail end of the recording sheet 3 is detected by the PE sensor 2 is shown in FIG. 12A. In this case, even when the recording sheet is conveyed by the discharge roller 11 and the spur wheels 12, the recording sheet 3 is conveyed without changing the convey distance per one line space between before and after the trail end of the recording sheet 3 is detected by the PE sensor 2. With this arrangement, the convey accuracy of the trail end of the recording sheet can be improved.

Figure 12B:
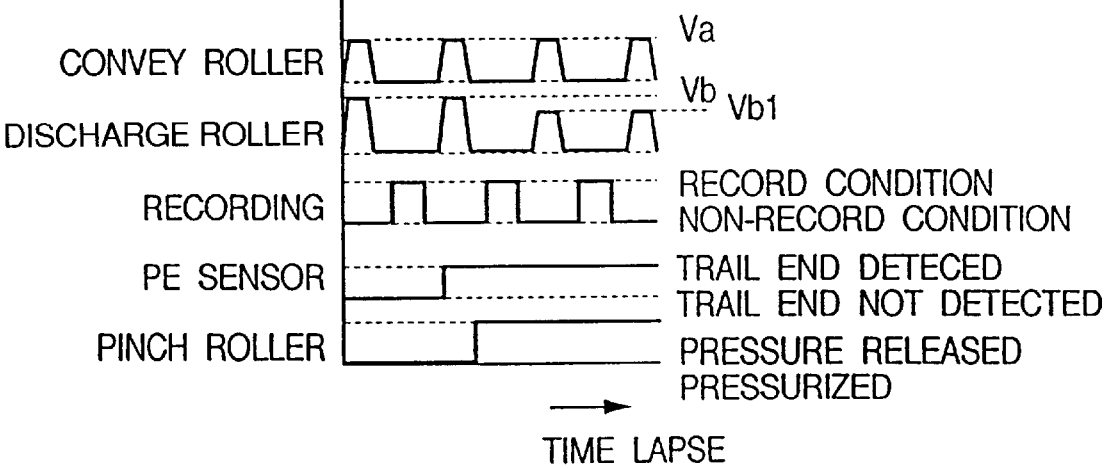
Figure 12C:
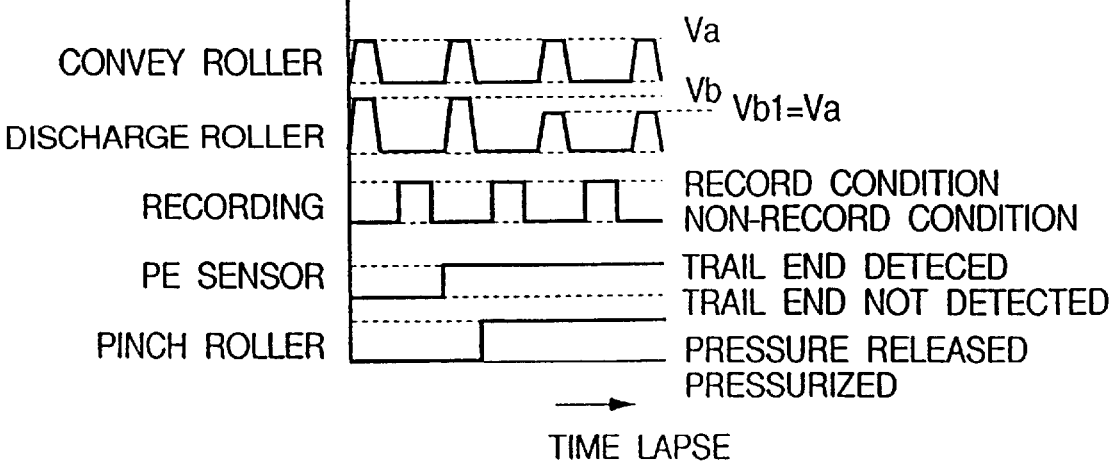

The third embodiment can be combined with the first embodiment. In such a combination, driving conditions shown in FIGS. 12B and 12C are used. In this case, in addition to the above-mentioned advantage, the increase in the convey distance of the recording sheet due to the downstream force F of the pinch roller 5 acting on the trail end of the recording sheet 3 can be prevented. Further, when this embodiment is combined with the first embodiment, although the predetermined position can be appropriately selected within the range between the separation position where the recording sheet has just left the pinch roller and the position situated upstream of the separation position and spaced apart from the separation position by the distance corresponding to one line space, the predetermined position may be situated upstream of such a range.

(Fourth Embodiment)

Next, a still further embodiment regarding constructions of convey and discharge rollers will be explained.

Figure 10:
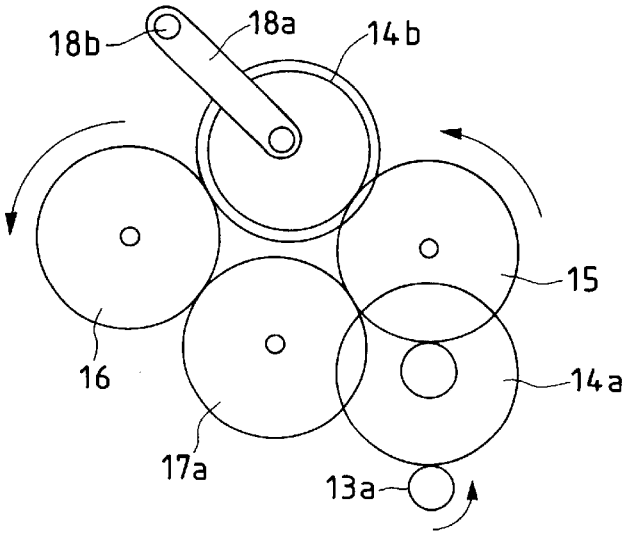
FIG. 10 is an explanatory view showing a concrete example of a drive system of the recording apparatus according to the fourth embodiment of the present invention.

FIG. 10 is an explanatory view showing a concrete arrangement of a drive system in which a convey roller and a discharge roller are driven by a common drive source and a clutch gear is interposed between a convey roller 4 and a discharge roller 11. A driving force from a motor gear 13*a* is transmitted to a convey roller gear 15 through a two-stage gear 14*a* and then is transmitted to a discharge roller gear 16 through a two-stage gear 14*b*. Further, the two-stage gear 14*b* is rotatably supported by a two-stage gear guide 18*a* and a two-stage gear guide shaft 18*b* so that the two-stage gear can be shifted upwardly by a solenoid (not shown). A clutch gear 17*a* has an input associated with the convey roller gear 15 and an output associated with the discharge roller gear 16. When the two-stage gear 14*b* is interposed between the convey roller gear and the discharge roller gear as shown, since the discharge roller gear is rotated faster than the convey roller gear, there is no connection between the input and the output of the clutch gear 17*a*. A total speed reduction gear ratio from the convey motor to the convey roller gear 15 is selected to 1:15 and a total speed reduction gear ratio from the discharge motor to the discharge roller gear 16 is selected to 2:29.

Figure 7:
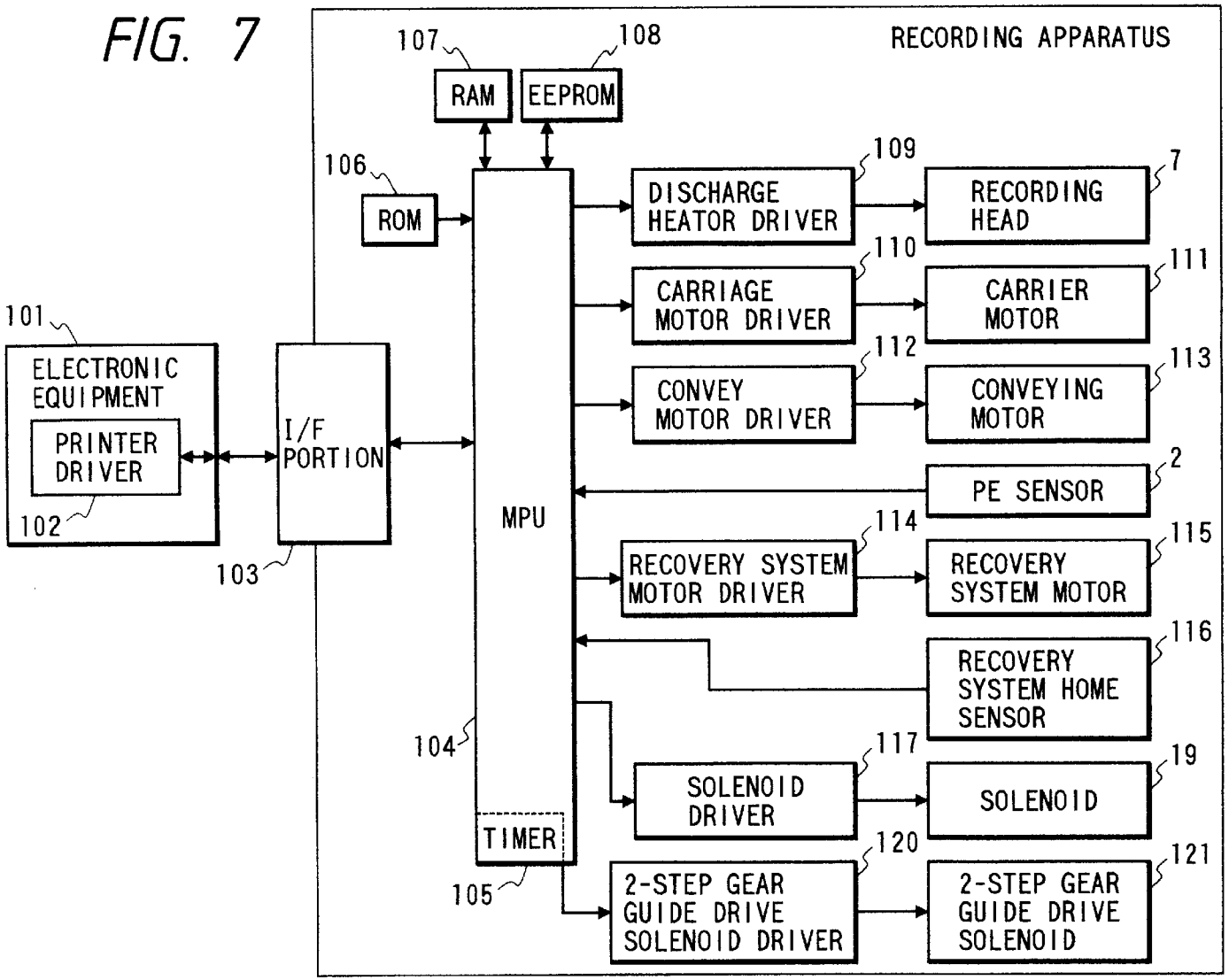
FIG. 7 is a block diagram showing a control portion of a recording apparatus according to a fourth embodiment of the present invention.

FIG. 7 is a block diagram showing a control portion of an ink jet recording apparatus according to this embodiment. In this control portion, a two-stage gear guide drive solenoid driver 120 for driving a two-stage gear guide drive solenoid 121 is added, in comparison with the control portion shown in FIG. 5.

In the recording operation regarding the recording sheet 3, the trail end of the recording sheet 3 is detected when the recording sheet 3 leaves the PE sensor lever 1, and the recording sheet 3 is conveyed by the predetermined distance L. Now, the two-stage gear 14*b* is shifted upwardly to disconnect the discharge roller gear 16 from the convey roller gear 15. In this case, the driving force is transmitted to the convey roller gear 15 through the two-stage gear 14*a* and then is transmitted to the discharge roller gear 16 through the input and the output of the clutch gear 17*a*. Since the speed reduction ratio from the convey motor to the convey roller gear 15 is 1:15 and the speed reduction ratio from the convey motor to the discharge roller gear 16 also becomes 1:15, the convey amount of the discharge roller 11 becomes the same as that of the convey roller 4. Thus, even when the recording sheet is conveyed by the discharge roller 11 and the spur wheels 12, since the recording sheet 3 is conveyed without changing the convey amount per one line space between before and after the trail end of the recording sheet 3 is detected by the PE sensor 2, the convey accuracy of the trail end of the recording sheet can be prevented from being worsened. Incidentally, FIG. 12A shows a driving condition in this case.

Further, the fourth embodiment can be combined with the first embodiment. In such a combination, a driving condition shown in FIG. 12C is used. In this case, in addition to the above-mentioned advantage, the increase in the convey distance of the recording sheet due to the downstream force F of the pinch roller 5 acting on the trail end of the recording sheet 3 can be prevented.

Further, when this embodiment is combined with the first embodiment, although the predetermined position can be appropriately selected within the range between the separation position where the recording sheet has just left the pinch roller and the position situated upstream of the separation position and spaced apart from the separation position by the distance corresponding to one line space, the predetermined position may be situated upstream of such a range.

Incidentally, in the present invention, the values set in the above-mentioned various embodiments are not limited to the aforementioned ones but may be appropriately selected. Further, the recording means of the recording apparatus is not limited to the ink jet recording system but may be of other recording type.

As mentioned above, the present invention relates to the recording apparatus in which the recording sheet is conveyed to the recording portion by a pinch roller and a convey roller while being pinched between these rollers, and after recording the recording sheet is pinched between and discharged by the discharge roller and the spur wheels, when the trail end of the recording sheet is conveyed to the predetermined position situated upstream of the position where the trail end of the recording sheet leaves the pinch roller. In such recording apparatus, by releasing or reducing the urging force or pressurizing force of the pinch roller or by reducing the convey amounts of the convey roller and the discharge roller or the convey amount of the discharge roller, the conveying accuracy of the trail end of the recording sheet can be prevented from being worsened, thereby improving the accuracy of the record position.

What is claimed is:

1. A recording apparatus including a recording portion for effecting recording on a recording sheet, said recording apparatus comprising:

convey means for conveying the recording sheet when recording is being effected on the recording sheet in said recording portion as well as for conveying the recording sheet to said recording portion by pinching the recording sheet between a pinch roller and a convey roller;

discharge means for discharging the recording sheet, said discharge means being disposed downstream of said recording portion;

urging means for urging said pinch roller against the recording sheet;

urging force controlling means for controlling an urging force of said urging means; and detecting means for detecting a trailing end of the recording sheet, said detecting means being disposed upstream of said convey means, wherein on the basis of a detection result output from said detecting means, said urging force controlling means reduces the urging force of said urging means when the trailing end of the recording sheet, on which recording is being effected in said recording portion, passes said convey means.

2. A recording apparatus including a recording portion for effecting recording on a recording sheet, said recording apparatus comprising:

convey means for conveying the recording sheet when recording is being effected on the recording sheet in said recording portion as well as for conveying the recording sheet to said recording portion by pinching the recording sheet between a pinch roller and a convey roller;

discharge means for discharging the recording sheet, said discharge means being disposed downstream of said recording portion;

urging means for urging said pinch roller against the recording sheet;

urging force controlling means for controlling an urging force of said urging means; and detecting means for detecting a trailing end of the recording sheet, said detecting means being disposed upstream of said convey means, wherein on the basis of a detection result output from said detecting means, said urging force controlling means releases the urging force of said urging means when the trailing end of the recording sheet, on which recording is being effected in said recording portion, passes said convey means.

3. A recording apparatus according to claims 1 or 2, further comprising a spur wheel and a discharge roller, wherein said discharge means discharges the recording sheet by pinching the recording sheet between said spur wheel and said discharge roller.

4. A recording apparatus according to claim 3, wherein said convey roller and said discharge roller are driven by a common drive source.

5. A recording apparatus according to claim 4, further comprising rotation controlling means for controlling rotations of said convey roller and said discharge roller, wherein said rotation controlling means reduces convey amounts of said convey roller and said discharge roller corresponding to one line space on the basis of a detection result output from said detecting means.

6. A recording apparatus according to claim 5, wherein said rotation controlling means sets a convey amount of said discharge roller to be the same as a convey amount of said convey roller, which is a convey amount existing before said detecting means detects the trailing end of the recording sheet.

7. A recording apparatus according to claim 3, wherein said convey roller and said discharge roller are driven by respective drive sources.

8. A recording apparatus according to claim 7, further comprising rotation controlling means for controlling a rotation of said discharge roller, wherein said rotation controlling means reduces a convey amount of said discharge roller corresponding to one line space on the basis of a detection result output from said detecting means.

9. A recording apparatus according to claim 8, wherein said rotation controlling means sets a convey amount of said discharge roller to be the same as a convey amount of said convey roller which is a convey amount existing before said detecting means detects the trailing end of the recording sheet.

10. A recording apparatus according to claim 1 or 2, wherein said recording portion is of an ink jet recording type in which recording is effected by discharging ink in response to a signal.

11. A recording apparatus according to claim 1 or 2, wherein said recording portion is of an ink jet recording type in which recording is effected by discharging ink by growth of a bubble formed by heating the ink so as to exceed a film-boiling temperature generated by energizing an electrical/thermal converter in response to a signal.

* * * * *

UNITED STATES PATENT AND TRADEMARK OFFICE

CERTIFICATE OF CORRECTION

PATENT NO. : 6,550,907 B2
DATED : April 22, 2003
INVENTOR(S) : Kota Uchida

It is certified that error appears in the above-identified patent and that said Letters Patent is hereby corrected as shown below:

Title page,
Item [56], References Cited, U.S. PATENT DOCUMENTS,
-- 5,910,811 6/1999 Sato …….347/104 -- should be inserted.

Drawings,
Sheet 5, Fig. 7, "HEATOR" should read -- HEATER --.

Figure 13:
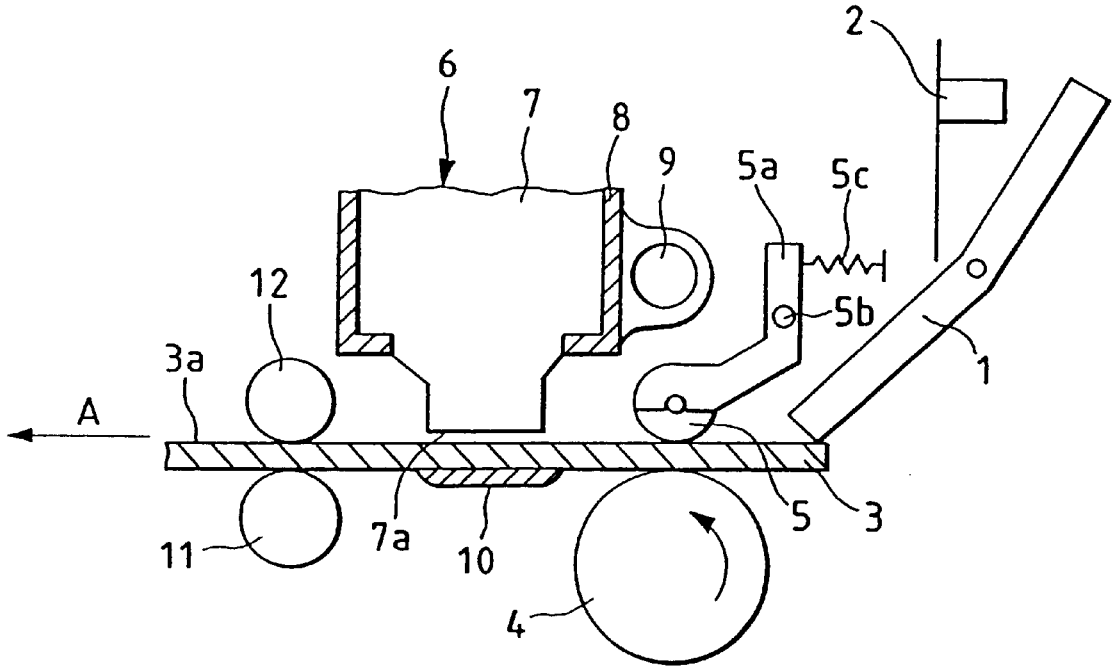
FIG. 13 PRIOR ART
FIG. 13 is an explanatory view showing a conventional recording apparatus.

Column 1,
Line 16, "with reference" should read -- will be explained with reference --; and
Line 17, "will be explained to FIG. 13," should read -- to FIG. 13, in which --.

Signed and Sealed this

Twenty-third Day of December, 2003

JAMES E. ROGAN
*Director of the United States Patent and Trademark Office*